US011202954B2

(12) United States Patent
Runzo et al.

(10) Patent No.: US 11,202,954 B2
(45) Date of Patent: Dec. 21, 2021

(54) HINGED LEG GUARD

(71) Applicant: Rawlings Sporting Goods Company, Inc., St. Louis, MO (US)

(72) Inventors: Zach Runzo, Maplewood, MO (US); Marc Schmidt, Weldon Spring, MO (US); Matt Slump, Chesterfield, MO (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 213 days.

(21) Appl. No.: 15/850,740

(22) Filed: Dec. 21, 2017

(65) Prior Publication Data

US 2019/0192954 A1 Jun. 27, 2019

(51) Int. Cl.
*A63B 71/12* (2006.01)
*A41D 13/05* (2006.01)
(Continued)

(52) U.S. Cl.
CPC ..... *A63B 71/1225* (2013.01); *A41D 13/0543* (2013.01); *A41D 13/0153* (2013.01); *A41D 13/065* (2013.01); *A63B 2071/125* (2013.01); *A63B 2071/1241* (2013.01); *A63B 2071/1258* (2013.01)

(58) Field of Classification Search
CPC ..... A63B 71/1225; A63B 2071/1241; A63B 2071/125; A63B 2071/1258; A63B 2071/1283; A63B 71/12; A41D 13/0543; A41D 13/055; A41D 13/06; A41D 13/065; A41D 13/05; A41D 13/015
See application file for complete search history.

(56) References Cited

U.S. PATENT DOCUMENTS 4,353,361 A * 10/1982 Foster ..... A61F 2/646 2/22
4,409,689 A * 10/1983 Buring ..... A63B 71/1225 2/22
(Continued)

FOREIGN PATENT DOCUMENTS

CA 2183517 A1 2/1998
CA 2295847 A1 1/1999
(Continued)

OTHER PUBLICATIONS

Google search for "linear define" (Year: 2020).*

*Primary Examiner* — Sally Haden

(57) ABSTRACT

The present invention relates to a hinged leg guard that may be used by catchers in diamond sports like baseball or softball. The hinged leg guard preferably includes a thigh guard, knee guard, shin guard that may be attached to one another by a flexible fabric. The thigh guard and shin guard also are preferably attached to a double hinge member that allows them to move relative to the knee guard. The knee guard also is preferably coupled to the double hinge member. When the hinged leg guard alternates between the extended and contracted position, an extension member of the knee guard preferably translates in one translational degree of freedom within a receiver of the hinge member. The translational movement preferably helps to keep the knee guard adjacent to the knee when a wearer crouches.

16 Claims, 3 Drawing Sheets

(51) Int. Cl.
*A41D 13/015* (2006.01)
*A41D 13/06* (2006.01)

(56) References Cited

U.S. PATENT DOCUMENTS 4,633,529 A * 1/1987 Litz ..... A63B 71/1225 2/22
5,172,425 A * 12/1992 Smith ..... A63B 71/1225 2/22
5,206,955 A 5/1993 Milligan
5,325,537 A 7/1994 Marion
5,337,418 A 8/1994 Kato et al.
5,447,498 A 9/1995 Watson
5,452,475 A 9/1995 Hunt
5,500,955 A 3/1996 Gongea
5,530,966 A 7/1996 West
5,561,857 A * 10/1996 Hoshizaki ..... A63B 71/1225 2/22
5,594,954 A 1/1997 Huang
5,611,080 A 3/1997 Skottheim
5,634,211 A 6/1997 Chen
5,652,956 A * 8/1997 Hoshizaki ..... A63B 71/1225 2/22
5,662,594 A * 9/1997 Rosenblatt ..... A61F 5/0125 2/16
5,711,028 A 1/1998 Bourque et al.
5,732,411 A 3/1998 Coleman et al.
5,742,938 A 4/1998 Winningham et al.
5,794,261 A 8/1998 Hefling
5,819,312 A 10/1998 Snyder et al.
5,829,055 A 11/1998 Collins et al.
5,950,249 A 9/1999 Clement
5,987,643 A 11/1999 Beutler
6,070,267 A 6/2000 McKewin
6,128,779 A 10/2000 Goldsmith et al.
6,131,195 A 10/2000 Foreman
6,161,226 A 12/2000 Serewicz et al.
6,178,555 B1 1/2001 Williams
6,178,556 B1 1/2001 Foreman et al.
6,182,299 B1 2/2001 Chen
6,237,149 B1 5/2001 MacDonald
6,269,485 B1 8/2001 Foreman
6,272,682 B1 8/2001 Fullum
6,279,168 B1 8/2001 Bean
6,405,383 B2 6/2002 Heller et al.
6,519,782 B2 2/2003 Collins et al.
6,553,572 B2 4/2003 Fiorini et al.
6,560,781 B1 5/2003 Keene et al.
6,654,961 B2 12/2003 Bland
6,678,899 B2 1/2004 Fiorini et al.
6,687,912 B2 2/2004 Collins et al.
6,789,264 B2 * 9/2004 Budda ..... A41D 13/0568 2/22
6,795,974 B1 * 9/2004 Howell ..... A41D 13/065 2/22
6,826,786 B2 12/2004 Fiorini et al.
6,832,390 B1 12/2004 Kleinert et al.
6,880,172 B2 4/2005 Quintero
6,912,729 B2 7/2005 Nishimoto
6,964,062 B1 11/2005 Chen
7,047,566 B2 5/2006 Bland et al.
7,065,800 B2 6/2006 Brown
7,114,189 B1 10/2006 Kleinert
7,188,370 B2 3/2007 Bevier
7,512,996 B2 4/2009 Yoo et al.
7,681,248 B2 3/2010 Legenstein
7,743,429 B2 6/2010 Bevier
7,765,615 B2 8/2010 Eastwood et al.
7,823,218 B2 11/2010 Goyer et al.
7,832,017 B2 11/2010 Nascimento et al.
7,841,018 B2 11/2010 Kotoske
7,845,017 B2 12/2010 Godshaw et al.
7,900,283 B1 3/2011 Chen
7,937,768 B2 5/2011 Behrend et al.
7,941,867 B2 5/2011 Olson
7,992,217 B2 8/2011 Hyde et al.
7,992,219 B2 8/2011 Bay
8,024,820 B2 9/2011 Weimer et al.
8,060,945 B2 11/2011 Adarraga
8,161,570 B2 4/2012 McVeigh et al.
RE43,395 E 5/2012 Budda
8,191,174 B2 6/2012 Winningham et al.
8,256,021 B2 9/2012 Nascimento et al.
8,316,463 B2 11/2012 Bevier
8,407,812 B2 4/2013 Godshaw et al.
8,510,862 B1 8/2013 Contant et al.
8,621,674 B2 1/2014 Perreault et al.
8,661,564 B2 3/2014 Dodd
8,832,871 B2 9/2014 Mazzarolo et al.
8,918,920 B2 12/2014 Jourde et al.
8,961,733 B2 2/2015 Dodd
9,021,614 B2 5/2015 Tepper et al.
9,067,122 B2 6/2015 Diamond
9,132,335 B2 9/2015 Contant et al.
9,149,709 B1 * 10/2015 Schuster ..... A63B 71/081
9,215,898 B2 12/2015 Clement et al.
9,328,788 B2 5/2016 Greenhill et al.
9,440,136 B2 9/2016 Smith
9,446,298 B2 9/2016 Keehu
2001/0047531 A1 12/2001 Spies
2002/0007509 A1 1/2002 Kamada
2003/0046752 A1 3/2003 Baumann
2004/0078861 A1 * 4/2004 Eghamn ..... A63B 71/1225 2/24
2005/0010150 A1 1/2005 Firsov
2005/0015841 A1 1/2005 Hoffman
2005/0015867 A1 1/2005 Emanuel
2005/0187071 A1 8/2005 Yamashita et al.
2005/0268365 A1 12/2005 Sandebeck
2006/0080762 A1 4/2006 Kobren et al.
2006/0085882 A1 4/2006 Broersma
2007/0214538 A1 9/2007 Castonguay et al.
2007/0250977 A1 11/2007 Brown et al.
2008/0120756 A1 5/2008 Shepherd
2008/0201828 A1 8/2008 Kanavage
2008/0209617 A1 9/2008 Castillo
2010/0287690 A1 11/2010 Kanavage
2011/0167548 A1 7/2011 Jourde et al.
2011/0219524 A1 9/2011 Perreault et al.
2012/0079647 A1 4/2012 Doherty et al.
2012/0180183 A1 7/2012 Mechling et al.
2012/0240303 A1 9/2012 Matta et al.
2012/0255096 A1 10/2012 Wesley
2013/0007938 A1 1/2013 LoCicero
2013/0014318 A1 1/2013 Jourde et al.
2013/0025017 A1 * 1/2013 Chen ..... A41D 13/065 2/22
2013/0086730 A1 4/2013 Wilkening et al.
2013/0318675 A1 12/2013 Mackey
2014/0215685 A1 8/2014 Bush et al.
2014/0230828 A1 8/2014 Gouniot et al.
2014/0259261 A1 9/2014 Mackey et al.
2014/0342852 A1 11/2014 Guertin
2015/0034511 A1 2/2015 Hughes
2015/0047090 A1 2/2015 Cook
2015/0106991 A1 4/2015 Gouniot
2015/0121599 A1 5/2015 Tjrnstrm
2015/0165302 A1 6/2015 Jaramillo et al.
2015/0237924 A1 8/2015 Cosio
2015/0264987 A1 9/2015 Morin et al.
2015/0297973 A1 10/2015 Beers
2015/0360116 A1 12/2015 Contant et al.
2016/0037851 A1 2/2016 Gupta et al.
2016/0038821 A1 2/2016 Mackey et al.
2016/0095362 A1 4/2016 Alomar, Jr. et al.
2016/0095363 A1 4/2016 Alomar, Jr. et al.
2016/0213996 A1 7/2016 Hammer

FOREIGN PATENT DOCUMENTS

CA 2542188 A1 10/2007
CA 2669890 A1 12/2010
CA 2762199 C 3/2013
CA 2852446 A1 11/2015

(56) References Cited

FOREIGN PATENT DOCUMENTS

| | | | |
|---|---|---|---|
| DE | 4035966 | C2 | 2/1995 |
| DE | 19882535 | T1 | 6/2000 |
| DE | 69701735 | T2 | 2/2001 |
| DE | 19825562 | C2 | 5/2001 |
| DE | 102012212789 | A1 | 1/2014 |
| EP | 916370 | A3 | 8/1999 |
| EP | 906039 | B1 | 4/2000 |
| EP | 684805 | B1 | 6/2001 |
| EP | 2001421 | A2 | 12/2008 |
| EP | 2079330 | A2 | 7/2009 |
| EP | 2437796 | A1 | 4/2012 |
| EP | 2540259 | A1 | 1/2013 |
| EP | 2815664 | A1 | 12/2014 |
| EP | 2961290 | A1 | 1/2016 |
| IN | 1006MUM2014 | A | 8/2014 |
| JP | 10046411 | A | 2/1998 |
| JP | 2886784 | B2 | 4/1999 |
| JP | 11114125 | A | 4/1999 |
| JP | 2000167098 | A | 6/2000 |
| JP | 2000176072 | A | 6/2000 |
| JP | 2002177435 | A | 6/2002 |
| JP | 3356637 | B2 | 12/2002 |
| JP | 2003073913 | A | 3/2003 |
| JP | 2003180905 | A | 7/2003 |
| JP | 3451242 | B2 | 9/2003 |
| JP | 2003293206 | A | 10/2003 |
| JP | 2003293207 | A | 10/2003 |
| JP | 2003293209 | A | 10/2003 |
| JP | 2004100114 | A | 4/2004 |
| JP | 2004100115 | A | 4/2004 |
| JP | 2005008996 | A | 1/2005 |
| JP | 3678700 | B2 | 8/2005 |
| JP | 2006280426 | A | 10/2006 |
| JP | 3138798 | U | 1/2008 |
| JP | 4030536 | B2 | 1/2008 |
| JP | 2008168088 | A | 7/2008 |
| JP | 2008223181 | A | 9/2008 |
| JP | 4236662 | B2 | 3/2009 |
| JP | 4309416 | B2 | 8/2009 |
| JP | 4324190 | B2 | 9/2009 |
| JP | 2010011921 | A | 1/2010 |
| JP | 4423308 | B2 | 3/2010 |
| JP | 4451875 | B2 | 4/2010 |
| JP | 4469827 | B2 | 6/2010 |
| JP | 4542082 | B2 | 9/2010 |
| JP | 4633144 | B2 | 2/2011 |
| JP | 4681633 | B2 | 5/2011 |
| JP | 4734357 | B2 | 7/2011 |
| JP | 4778977 | B2 | 9/2011 |
| JP | 4820199 | B2 | 11/2011 |
| JP | 4834117 | B2 | 12/2011 |
| JP | 4888438 | B2 | 2/2012 |
| JP | 4964924 | B2 | 7/2012 |
| JP | 5036794 | B2 | 9/2012 |
| JP | 5097805 | B2 | 12/2012 |
| JP | 3183108 | U | 4/2013 |
| JP | 5192008 | B2 | 5/2013 |
| JP | 5269667 | B2 | 8/2013 |
| JP | 5280565 | B2 | 9/2013 |
| JP | 5356352 | B2 | 12/2013 |
| JP | 5429669 | B2 | 2/2014 |
| JP | 2014124392 | A | 7/2014 |
| JP | 2014236893 | A | 12/2014 |
| JP | 2015058179 | A | 3/2015 |
| JP | 5775905 | B2 | 9/2015 |
| JP | 2016083076 | A | 5/2016 |
| JP | 5966141 | B2 | 8/2016 |
| KR | 100819262 | B1 | 3/2008 |
| KR | 200453052 | Y1 | 3/2011 |
| KR | 1020160077945 | A | 7/2016 |
| WO | 9404048 | | 3/1994 |
| WO | 9628223 | | 9/1996 |
| WO | 9828054 | | 7/1998 |
| WO | 2007036751 | A2 | 4/2007 |
| WO | 2007061379 | A1 | 5/2007 |
| WO | 2007077368 | A2 | 7/2007 |
| WO | 2008122873 | A1 | 10/2008 |
| WO | 2012105359 | A1 | 8/2012 |
| WO | 2012114300 | A1 | 8/2012 |
| WO | 2015088863 | A2 | 6/2015 |

* cited by examiner

HINGED LEG GUARD

FIELD OF THE INVENTION

The present invention generally relates to a protective, hinged leg guard. More particularly, the present invention relates to a hinged leg guard for use by catchers in diamond sports like softball or baseball. The hinged leg guard preferably allows for more natural movement, for example as a catcher transitions between standing and crouching, or when running.

BACKGROUND OF INVENTION

Leg guards have long existed for baseball and softball catchers to protect shins, knees, and thighs. Such leg guards provide a level of protection for catchers' legs from errant throws, batted balls (often foul balls), thrown bats, and collisions with other players. Because catchers so often switch between a crouched and standing position, and because they must often run in their leg guards, leg guards designs have increasingly aimed at allowing natural movements in those situations.

Standard leg guards for catchers typically are made up of four guards: thigh, knee, shin, and foot guards. In those designs, the thigh guard is connected to an upper portion of the knee guard, and the shin guard is connected to a lower portion of the knee guard. The foot guard is connected to a lower portion of the shin guard. The guard is configured so that, when worn, the thigh guard, knee guard, and shin guard align with the thigh, knee, and shin, respectively, and the foot guard aligns with the wearer's foot.

Older knee guards were often configured as a "triple kneecap design." Those knee guards included three separate protective components that came together to form the knee guard portion of the leg guard, often with extra padding. The thigh and shin guards of those prior art leg guards may also include extra padding. Prior art guards are typically made up of a high-impact resistant plastic which covers the padding.

Some existing leg guards include a flexible fabric or other elastic component that attaches the knee guard to the thigh guard, the knee guard to the shin guard, and the shin guard to the foot guard. Such flexibility preferably allows the leg guard to be at least somewhat adaptive to a wearer's legs when he or she alternates between the standing and crouching positions. However, the flexible fabric (or other flexible attachment member) can allow the hard plastic portions of the leg guard to separate from one another (for example, the knee guard from the thigh guard), thus forming gaps that expose portions of the wearer's leg to errant balls, bats, and the like. Moreover, the flexible fabric does not provide any sort of protection against overextension of the knee.

At least one prior art leg guard is known to be hinged to allow for the thigh, knee, and shin to be covered in a crouched position. That solution includes a side plate that hingedly connects the knee guard with the thigh and shin guards. However, that leg guard creates a new problem. When the wearer is in a crouched position, versus a standing position, the user's knee may project more or less forwardly depending on the wearer's body. Therefore, such existing leg guards further do not substantially mimic the natural motions of a wearer's legs when the guard is worn.

As such, a leg guard is needed that provides substantial protection from bats and balls, but also protects the wearer from hyperextending his or her knee. The solution should substantially mimic the natural range of motion of the wearer's knee so that the leg guard is comfortable.

SUMMARY OF INVENTION

The present invention provides a hinged leg guard that aims to protect the thigh, knee, shin, and foot of each leg of a wearer. The leg guard may be used (with a second leg guard so that both legs are protected) for diamond sport athletes, or other individuals needing to protect their legs.

The invention preferably includes each of a thigh guard, knee guard, shin guard, and foot guard. The thigh guard, knee guard, shin guard, and foot guard may be made of a high impact resistant plastic or other suitable material to help protect wearers against errant balls or bats, or collisions with other athletes. The interior of the aforementioned thigh, knee, and shin guards may also include padding that is adjacent a wearer's thigh, knee, or shin when the guards are worn. The shape of the thigh guard, knee guard, shin guard, and foot guard preferably are in substantially the same shape and size as the front and/or side portions of human thighs, knees, shins, and feet, respectively. Thus, when the leg guard is worn, the thigh, knee, shin, and foot are substantially and snugly covered by the guards associated with those body parts. Strap members may further be provided at various positions along the length of each leg guard that may aid in snugly securing the various guards to their respective body parts.

The hinged leg guard also preferably includes a double hinge member associated with each side of a leg guard to which the thigh guard, knee guard, and shin guard may be coupled. The thigh guard and the shin guard are each preferably hingedly attached to the knee guard (for example, by rotatable bolts) so that they may each independently move relative to the knee guard. As such, the thigh guard and the knee guard preferably remain substantially adjacent the wearer's thigh and shin, respectively, as a wearer transitions between standing or crouched positions, or otherwise moves.

Moreover, the knee guard preferably includes a side panel on each of its side portions. Each side panel preferably includes an extension member that extends rearwardly from each of the two side panels. Each extension member is preferably received by a receiver located in the double hinge member. One translational degree of freedom is preferably provided between the extension member and the receiver so that the extension member may slidingly translate within the receiver in the manner described below.

When a wearer crouches, the strap members securing the thigh guard and shin guard to a wearer's leg preferably continue to press those guards snugly against a wearer. In turn, the thigh and shin guards may press the knee guard against the leg of a wearer. The extension members on the side panels of the knee guard preferably allow translation of the knee guard as dictated by the wearer's knee to allow for better fit and protection.

This translational movement provides the one translational degree of freedom between the knee guard and the hinge member. The translational degree of freedom preferably allows the knee guard to move forwardly or rearwardly with the knee when a wearer enters a crouched position. Gap created between the knee guard and the knee are therefore reduced. Further, because the knee guard moves forwardly/rearwardly when the wearer's knee moves forwardly/rearwardly (for instance, when running or crouching), the hinged leg guard in the present invention allows for a more natural range of motion when worn and during movement.

DETAILED DESCRIPTION OF THE INVENTION

The present invention relates to a hinged leg guard for use by catchers in diamond sports. The hinged preferably moves naturally with the knee of a wearer to allow for more comfortable wear. Further, it preferably reduces the likelihood that a gap between a wearer's knee and a knee guard associated with the leg guard is created.

Figure 1:
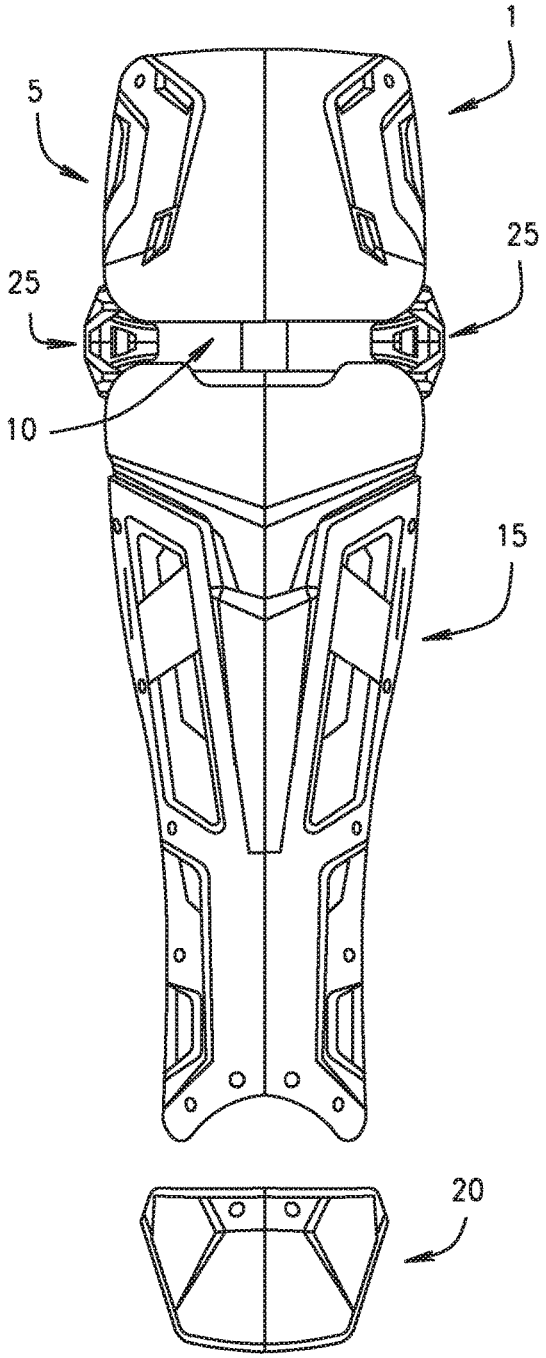
FIG. 1 is a front elevation view of a hinged leg guard constructed according to the teachings of the present invention.

Referring now to FIG. 1, a hinged leg guard 1 is provided for a catcher in a diamond sport to wear in the field during play. While only one leg guard 1 is shown in FIGS. 1-4, it should be appreciated that typically a catcher in a diamond sport (or other user) would wear a leg guard 1 on each of his or her legs, both of which are substantially similar to the leg guard 1.

As shown in FIG. 1, the leg guard 1 preferably includes each of a thigh guard 5, knee guard 10, shin guard 15, and foot guard 20. The thigh guard 5 and the knee guard 10 are preferably coupled to one another by one or more double hinge members 25 located on one or both sides of the shin guard 1. The mechanism by which the double hinge members 25 couple the thigh guard 5 and the knee guard 10 to one another is detailed when describing FIG. 2 below.

The knee guard 10 and the shin guard 15 are also preferably coupled to one another using the double hinge members 25. Again, the various structures of the knee guard 10 and the shin guard 15 that preferably allow the guards 10, 15 to be coupled to one another by the hinge members 25 are detailed when describing FIG. 2 below.

Preferably, each of the thigh guard 5, knee guard 10, shin guard 15, and foot guard 20 are formed of a high-impact resistant plastic. Further, they may include foam padding on their interior portions (not illustrated) that is designed to abut the thigh, knee, shin, and foot, respectively, when the leg guard 1 is worn. Each of the guards 5, 10, 15, 20 that make up the leg guard 1 are preferably molded to substantially fit the body part they are designed to protect, and thus their interiors (not illustrated) are shaped substantially similarly to those body parts (thigh, knee, shin, upper foot). In a preferred embodiment, the foot guard 20 and the shin guard 15 are attached to one another using a flexible fabric, such as a nylon strap (not illustrated).

Figure 2:
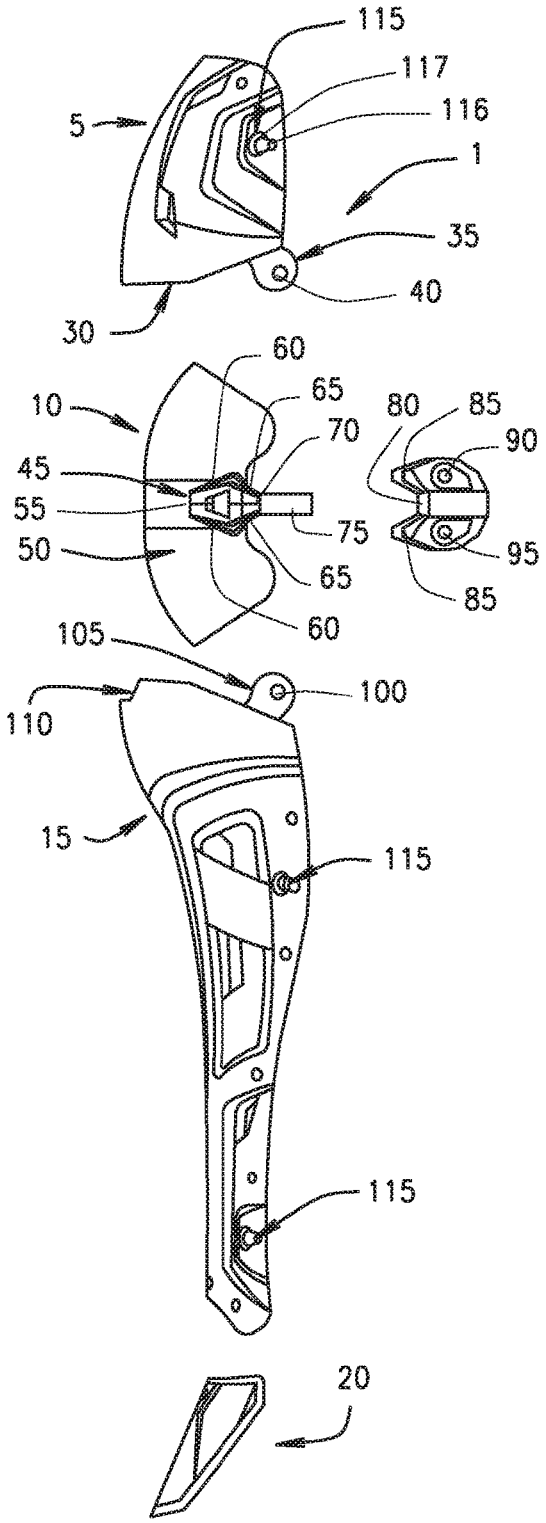
FIG. 2 is an exploded side elevation view of the hinged leg guard of FIG. 1.

Turning now to FIG. 2, the thigh guard 5, knee guard 10, shin guard 15, and foot guard 20 are illustrated as exploded from one another. As shown in FIG. 2, a lower portion 30 of the thigh guard 5 is preferably provided with a tab member 35 which projects downwardly therefrom. It should be noted that a substantially similar tab member (not illustrated) is preferably provided opposite the tab member 35 on the other side of the thigh guard 5 for coupling to the other hinge member 25 (shown in FIG. 1). The tab member 35 is preferably provided with an aperture 40 that extends completely through the tab member 35. The tab member 35 and its aperture 40 preferably help to secure the thigh guard 5, knee guard 10, and double hinge member 25, as will be described below.

The knee guard 10 preferably includes a side panel 45 which projects outwardly from a side portion 50 of the knee guard 10. The side panel 45 is preferably integrally formed with the knee guard 10, though in alternative embodiments, it may be attached to the knee guard 10 in an alternative manner, for example by bolting the side panel 45 to the knee guard 10.

As shown, the side panel 45 may have a flat front portion 55 that is raised from the side portion 50 of the knee guard 10, and is located near the front of the knee guard 10. It also preferably includes first side portions 60 that extend rearwardly from the flat front portion 55 and outwardly from each other as they get farther from the flat front portion 55. Second side portions 65 may extend rearwardly from the first side portions 60, and inwardly toward each other as they approach a rear flat portion 70 of the side panel 45. It is noted that other structures are envisioned.

The rear flat side portion 70 preferably includes an extension member 75 which extends rearwardly therefrom. The extension member 75 is illustrated as being substantially rectangular in shape. As will be described herein below, the extension member 75 may couple a knee guard 10 to a double hinge member 25, although other shapes of the extension member 75 are envisioned.

The double hinge member 25 preferably includes a receiver 80 that extends through an interior (not illustrated) along the width of the double hinge member 25. The receiver 80 is preferably sized and shaped to receive the extension member 75 so that the extension member 75 may freely slide in and out of the receiver 80 when the leg guard 1 contracts and extends in the manner described below (for example, when a wearer alternates between a standing and crouching position).

The double hinge member 25 also preferably includes side portions 85 that converge toward one another as they approach the receiver 80. Those side portions 85 are preferably designed to complement the second side portions 65 of the knee guard 10. When the extension member 75 and the receiver 80 are mated with one another in the manner described hereinbelow, the side portions 85, 65 substantially abut one another. Each side panel 45 may be securely fitted with and coupled to each hinge member 25.

Each double hinge member 25 is further preferably provided with each of an upper aperture 90 and a lower aperture 95. In the illustrated embodiment, the upper aperture 90 is preferably located to align with the aperture 40 of the tab member 35 on the thigh guard 5 when the and the lower aperture 95 is preferably located to align with an aperture 100 on a tab member 105 of the shin guard 15. That tab member 105 (and its aperture 100 that extends through the tab member 105) is preferably positioned at an upper portion 110 of the shin guard 15. Like the thigh guard 5 (and its tab member 35), the shin guard 15 preferably includes a tab member opposite the tab member 105 (not illustrated) to be coupled to the other hinge member 25 that is in substantial alignment with the tab member 105, and is substantially sized and shaped like the tab member 105.

In view of the above, when the thigh guard 5, the knee guard 10, and the shin guard 15 are selectively attached to one another via the double hinge member 25, various portions of the thigh guard 5, knee guard 10, shin guard 15, and double hinge member 25 are interconnected as described hereinbelow.

More particularly, when the hinged leg guard 1 is assembled, the apertures 40 on either side of the thigh guard 5 are preferably aligned with the upper apertures 90 of the double hinge members 25 on either side of the sides of the legs 1. Similarly, the apertures 100 of the shin guard 15 are preferably aligned with the lower apertures 95 of each of the double hinge members 25 on both sides of a leg guard 1. In a preferred embodiment, a freely rotatable bolt or other fastening member (not illustrated) is preferably inserted through the apertures 40 and 90, and 100 and 95, respectively to secure the thigh guard 5 and the shin guard 15 to the double hinge member 25. A separate rotatable bolt (not illustrated) also preferably couples the tab members not shown in FIG. 2 that are opposite the tab members 35, 105 to the other hinge member 25 shown in FIG. 1. The rotatable bolt preferably allows for the tab members 35 and 105 (and their respective guards) to rotate relative to the hinge member 25 (as well as the tab members opposite the tab members 35 and 105 to rotate relative to the other hinge member 25). The thigh guard 5 and the shin guard 15 thus may each rotate relative to the knee guard 10, along different rotational axes although such axes may be parallel.

Furthermore, when the hinged leg guard 1 is assembled, the extension member 75 of the knee guard 10 is preferably received within the receiver 80 in the manner described above. Thus, the thigh guard 5, knee guard 10, and shin guard 15 are preferably each separately coupled to the double hinge member 25. This allows for each of the thigh guard 5 and shin guard 15 to independently rotate relative to one another which the knee guard 10 independently translates freely. Such independent movement preferably allows the hinged leg guard 1 to closely mimic the natural movements of a wearer's leg, as will be described hereinbelow in greater detail.

A plurality of banjo-shaped receivers 115 are also illustrated in FIG. 2. As understood in the art, banjo-shaped receivers like the banjo-shaped receivers 115 include two immediately adjacent and integrally formed portions: a smaller portion 116 and a larger portion 117. A corresponding male fastening structure preferably includes an engagement member, preferably having a T-shaped cross-section. The upper portion of the T-shaped cross-section preferably has a diameter smaller than the larger portion 117 of the receiver 115, but larger than the smaller portion 116. As such, the engagement member may be inserted into the receiver 115 via the larger portion 117 and moved to the smaller portion 116, which retains the engagement member according to known methods.

The banjo-shaped receivers 115 are illustrated as being located on the thigh guard 5 (one banjo-shaped receiver 115) and the shin guard 15 (two banjo-shaped receivers 115). The banjo-shaped receivers 115 are preferably located apart from one another at an appropriate distance to allow strap members (not illustrated) having fastening means to be wrapped around a wearer's leg to secure the leg guard 1 to a leg of a wearer. The strap members preferably more securely couple the thigh guard, knee guard, and shin guard to a wearer's thigh, knee, and shin, respectively.

Figure 3:
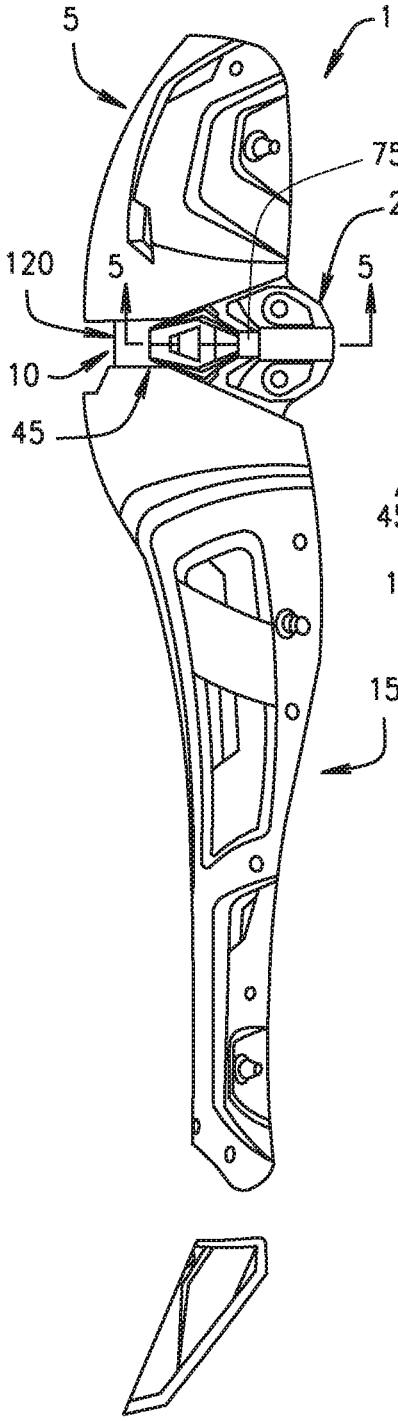
FIG. 3 is a side elevation view of the hinged leg guard of FIGS. 1 and 2 in its extended position.
Figure 4:
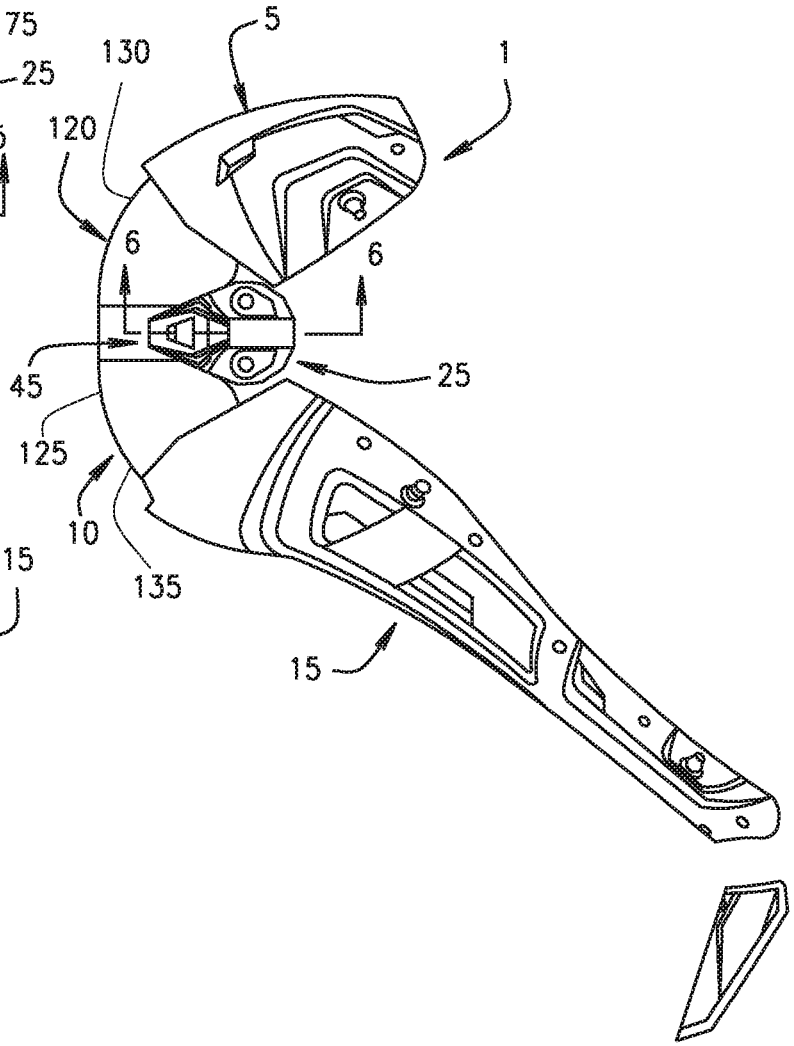
FIG. 4 is a side elevation view of the hinged leg guard of FIGS. 1-3 in its contracted position.

Turning now to FIGS. 3 and 4, the hinged leg guard 1 is shown in its extended and contracted positions, respectively. As shown in FIGS. 3 and 4, the hinged leg guard 1 may be in the extended position when a user is standing while wearing the leg guard 1, and may be in its contracted position when a wearer is in a crouched, or squatting, position. Of course, this may differ depending on the wearer.

In the extended position shown in FIG. 3, because a wearer's leg is preferably extended or straight when he or she is standing, the thigh guard 5 and the shin guard 15 have not moved relative to the double hinge member 25. As such, in the extended position, much of the outward facing front portion 120 of the knee guard 10 is substantially hidden from view behind the thigh guard 5 and the shin guard 15. Similarly, if the wearer's knee has somewhat pressured the knee guard 10 outwardly, the extension member 75 would be somewhat removed from the double hinge member 25 and its receiver 80 (contrasted with the contracted position shown in FIG. 4), as is discussed in greater detail hereinbelow.

Turning to FIG. 4, the leg guard 1 is shown as though a wearer has preferably entered into a crouched, or squatting, position, and as such the leg guard 1 is in its bent or contracted position. When a wearer enters such a crouched or squatted position, the wearer's thigh and shin each have preferably rotated relative to the wearer's knee. Thus, each of the thigh guard 5 and the shin guard 15 have also preferably rotated within the hinge members 25 relative to the knee guard 10. In doing so, the thigh guard 5 and the shin guard 15 preferably remain substantially abutting the wearer's thigh and shin, respectively, because of the shape of the guards 5 and 15 that fit the thigh and shin, respectively. Moreover, the thigh guard 5 and the shin guard 15 preferably remain substantially abutting the wearer's thigh and shin because the straps (not illustrated) that preferably attach the leg guard 1 to a wearer also retain the thigh guard 5 and the shin guard 15 against the thigh and shin, respectively, of the wearer.

The strap members also preferably help to secure the knee guard 10 to a wearer's knee. Pulling force generated by the strap members preferably causes the knee guard 10 in each leg guard 1 to be pulled toward, and possibly secured against a wearer's knee. When this happens, the side panel 45 may also be pushed rearwardly toward the wearer's knee. If the side panel 45 is forced rearwardly toward the wearer's knee by the strap member, the extension member 75 is pushed rearwardly also into the receiver 80 of the hinge member 25. Again, although the structure hereof allows for such relative movement, such movement would depend on the wearer's body.

The extension member 75 and the receiver 80 are not visible in FIG. 4 because the extension member 75 has been substantially received by the receiver 80. This ability of the extension member 75 to slide in and out of the receiver 80 allows the knee guard 10 to stay substantially aligned with a wearer's knee when he or she moves or runs or crouches. It does so by providing one translational degree of freedom for the knee guard 10 as the extension member 75 slides in and out of the receiver 80. This translational degree of freedom is provided in greater detail in FIGS. 5 and 6.

By remaining substantially aligned with and abutting a wearer's knee when he or she runs or stands or crouches, the natural motion of the leg is better replicated. If the knee guard 10 did not move so as to stay close to a wearer's knee (as prior art leg guards fail to do), a gap may be provided between the knee guard and a wearer's knee. Such a gap could expose a wearer's knee to an errant batted or thrown ball that could injure his or her knee.

Also, it should be noted that when the leg guard 1 is contracted as shown in FIG. 4, a greater area of the front portion 120 of the knee guard 10 that faces outwardly from a wearer is exposed than when the leg guard 1 is in the extended position shown in FIG. 3. The front portion 120 preferably substantially covers the knee of a wearer sufficiently to protect his or her leg when the leg guard 1 is worn, and more particularly when the wearer is in his or her crouched position. As shown in FIG. 4, a central surface 125 of the front portion 120 of the knee guard 10 is substantially flat, while an upper surface 130 and a lower surface 135 of the front portion 120 are substantially rounded. The knee guard 10 is preferably shaped in this way to substantially conform to the knee in both of its extended and bent positions, as well as during the transition between being extended and being bent.

Figure 5:
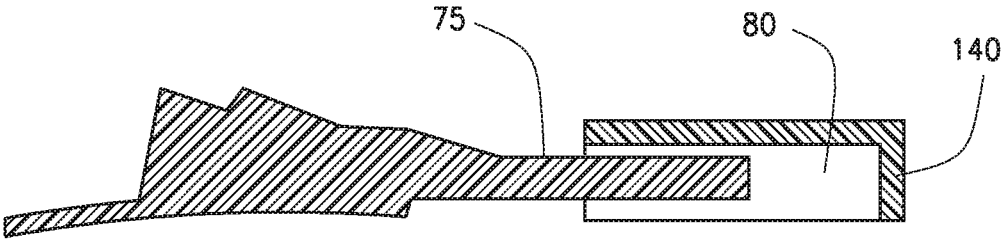
FIG. 5 is a cross-section view taken across line 5-5 in FIG. 3.
Figure 6:
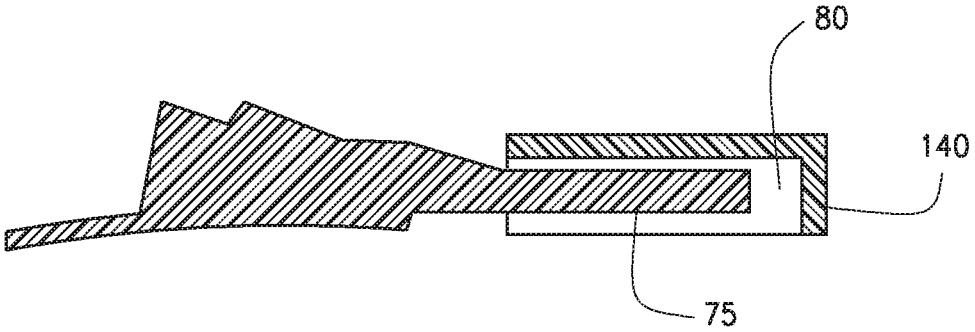
FIG. 6 is a cross-section view taken across line 6-6 in FIG. 4.

FIGS. 5 and 6 illustrate the relationship between the extension member 75 and the receiver 80 in the extended and contracted positions, respectively. As shown in FIGS. 5 and 6, the extension member 75 is provided with one degree of translational freedom within the receiver 80. When a wearer crouches or stands or runs, the extension member 75 may translate forwardly or rearwardly. In FIG. 5, the extension member 75 is mostly removed from the receiver 80, but in FIG. 6 the extension member is mostly received and secured by the receiver 80. In FIGS. 5 and 6, the receiver 80 is provided with a back wall 140 to limit the translation of the extension member 75. However, in alternative embodiments, the rear of the receiver 80 may be provided with an open back rather than the back wall 140.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required".

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A hinged leg guard comprising:

a shin guard;

a thigh guard;

at least one double hinge member including a receiver extending therethrough, said at least one double hinge member attached to the shin guard at a first hinge axis, and attached to the thigh guard at a second hinge axis;

a knee guard including an upper portion and a lower portion, and at least one extension member having a length, the receiver of the at least one double hinge member receiving the at least one extension member;

wherein as the leg guard transitions from an extended position to a contracted position, the at least one extension member is received farther into the receiver of the at least one double hinge member, such that more of the length of the at least one extension member is positioned through the receiver in the contracted position than in the extended position; and wherein in an extended position more of the upper portion of the knee guard is received in the thigh guard and more of the lower portion of the knee guard is received in the shin guard than when the leg guard is in a contracted position.

2. The hinged leg guard of claim 1, wherein the knee guard includes two side panels, and wherein each of the two side panels includes the at least one extension member.

3. The hinged leg guard of claim 2, wherein the at least one double hinge member comprises a first double hinge member and a second double hinge member, wherein the first double hinge member is located on a first side portion of the knee guard and the second double hinge member is located on a second side portion of the knee guard for receiving the at least one extension member from each of the two side panels.

4. The hinged leg guard of claim 1 wherein the hinged leg guard includes a foot guard.

5. The hinged leg guard of claim 1 wherein the thigh guard includes a tab member extending downwardly from the thigh guard, the tab member further including an aperture that extends through the tab member.

6. The hinged leg guard of claim 5 wherein the at least one double hinge member includes an upper aperture that aligns with the aperture of the tab member when the thigh guard and the at least one double hinge member are attached to one another.

7. The hinged leg guard of claim 1 wherein the shin guard includes a tab member extending upwardly from the shin guard, the tab member further including an aperture that extends through the tab member.

8. The hinged leg guard of claim 7 wherein the at least one double hinge member includes a lower aperture that aligns with the aperture of the tab member when the shin guard and the at least one double hinge member are attached to one another.

9. A hinged leg guard comprising:

a knee guard including an upper portion and a lower portion, and a first side panel located on at least one side portion of the knee guard, the first side panel further including at least one extension member having a length, the at least one extension member extending rearwardly from the first side panel;

a double hinge member including a receiver for receiving the at least one extension member of the first side panel;

a thigh guard attached to an upper portion of the double hinge member;

a shin guard attached to a lower portion of the double hinge member;

wherein when the leg guard transitions from an extended position to a contracted position, the at least one extension member is received farther into the receiver in one degree of freedom such that more of the length of the at least one extension member is positioned through the receiver in the contracted position than in the extended position; and wherein in an extended position more of the upper portion of the knee guard is received in the thigh guard and more of the lower portion of the knee guard is received in the shin guard than when the leg guard is in a contracted position.

10. The hinged leg guard of claim 9, wherein the knee guard includes a second side panel, and the at least one side portion of the knee guard comprises a first side portion and a second side portion, and wherein each of the first and second side panels includes the at least one extension member.

11. The hinged leg guard of claim 10, wherein the double hinge member comprises a first double hinge member and a second double hinge member, wherein the first double hinge member is located on the first side portion of the knee guard and the second double hinge member is located on the second side portion of the knee guard for receiving the at least one extension member of each of the first and second side panels.

12. The hinged leg guard of claim 9 wherein the hinged leg guard includes a foot guard.

13. The hinged leg guard of claim 9 wherein the thigh guard includes a tab member extending downwardly from the thigh guard, the tab member further including an aperture that extends through the tab member.

14. The hinged leg guard of claim 13 wherein the double hinge member includes an upper aperture that aligns with the aperture of the tab member when the thigh guard and the double hinge member are attached to one another.

15. The hinged leg guard of claim 9 wherein the shin guard includes a tab member extending upwardly from the shin guard, the tab member further including an aperture that extends through the tab member.

16. The hinged leg guard of claim 15 wherein the double hinge member includes a lower aperture that aligns with the aperture of the tab member when the shin guard and the double hinge member are attached to one another.

* * * * *